US007634861B2

(12) United States Patent
Kilgore

(10) Patent No.: US 7,634,861 B2
(45) Date of Patent: Dec. 22, 2009

(54) FOOTWEAR WITH LONGITUDINALLY SPLIT MIDSOLE FOR DYNAMIC FIT ADJUSTMENT

(75) Inventor: Bruce J. Kilgore, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 148 days.

(21) Appl. No.: 10/850,453

(22) Filed: May 21, 2004

(65) Prior Publication Data

US 2005/0257405 A1 Nov. 24, 2005

(51) Int. Cl.
*A43B 3/26* (2006.01)

(52) U.S. Cl. ..... 36/97; 36/102; 36/93; 36/43; 36/45; 36/28

(58) Field of Classification Search ..... 36/97, 36/102, 103, 93, 43, 44, 25 R, 31
See application file for complete search history.

(56) References Cited

U.S. PATENT DOCUMENTS

| | | | | |
|---|---|---|---|---|
| 3,086,301 A | | 4/1963 | Pastor | |
| 3,404,468 A | * | 10/1968 | Rosen | 36/11 |
| 3,624,930 A | | 12/1971 | Johnson et al. | |
| 3,629,961 A | | 12/1971 | Self | |
| 3,705,463 A | | 12/1972 | Lown | |
| 3,724,105 A | | 4/1973 | Weight | |
| 3,748,756 A | * | 7/1973 | White | 36/97 |
| 3,916,539 A | | 11/1975 | Pankin et al. | |
| 3,952,430 A | | 4/1976 | Pankin et al. | |
| 4,215,493 A | | 8/1980 | Antonious | |
| 4,270,285 A | | 6/1981 | Antonious | |
| 4,309,832 A | | 1/1982 | Hunt | |
| 4,451,995 A | | 6/1984 | Antonious | |
| 4,506,460 A | | 3/1985 | Rudy | |
| 4,541,184 A | | 9/1985 | Leighton | |
| 4,551,903 A | | 11/1985 | Graham et al. | |
| 4,559,723 A | | 12/1985 | Hamy et al. | |
| 4,559,724 A | | 12/1985 | Norton | |
| 4,590,123 A | | 5/1986 | Hashimoto et al. | |

(Continued)

FOREIGN PATENT DOCUMENTS

CA 2565948 12/2005

(Continued)

OTHER PUBLICATIONS

Dakkak Brothers Company, Our Products: Microcellular Rubber Sheets, T.P.R.—Granules, EVA Compound, Rubber Compound [online], http://www.dakkakco.com/productsl.html [publication date unknown], pp. 1/3-3/3.

(Continued)

*Primary Examiner*—Jila M Mohandesi
(74) *Attorney, Agent, or Firm*—Plumsea Law Group, LLC

(57) ABSTRACT

An article of footwear is constructed to dynamically provide width adjustment by cooperative expansion and contraction of a longitudinal split midsole with an expansion element integrated with an outsole that allows the midsole to expand from a narrow width to a wider width. The upper of the shoe has a corresponding section that can expand to a similar degree as the midsole and outsole to enable the volume of the upper to increase proportionally to the width of the sole.

18 Claims, 8 Drawing Sheets

U.S. PATENT DOCUMENTS

| | | | | | |
|---|---|---|---|---|---|
| 4,599,810 | A | | 7/1986 | Sacre | |
| 4,615,126 | A | | 10/1986 | Mathews | |
| 4,654,983 | A | | 4/1987 | Graham et al. | |
| 4,658,516 | A | | 4/1987 | Beck | |
| 4,724,624 | A | | 2/1988 | Duclos | |
| RE33,018 | E | * | 8/1989 | Ostrander | 36/102 |
| 4,910,887 | A | | 3/1990 | Turner et al. | |
| 4,944,099 | A | | 7/1990 | Davis | |
| 5,025,573 | A | | 6/1991 | Giese et al. | |
| 5,060,402 | A | | 10/1991 | Rosen | |
| 5,123,181 | A | * | 6/1992 | Rosen | 36/97 |
| 5,203,097 | A | | 4/1993 | Blair | |
| 5,241,762 | A | * | 9/1993 | Rosen | 36/97 |
| 5,329,704 | A | * | 7/1994 | Martin, Jr. | 36/7.1 R |
| 5,337,492 | A | | 8/1994 | Anderie et al. | |
| 5,367,791 | A | | 11/1994 | Gross et al. | |
| 5,367,792 | A | | 11/1994 | Richard et al. | |
| 5,404,658 | A | * | 4/1995 | Rosen | 36/97 |
| 5,423,135 | A | | 6/1995 | Poole et al. | |
| 5,499,459 | A | | 3/1996 | Tomaro | |
| 5,529,830 | A | | 6/1996 | Dutta et al. | |
| 5,555,650 | A | | 9/1996 | Longbottom et al. | |
| 5,566,475 | A | | 10/1996 | Donnadieu | |
| 5,659,914 | A | | 8/1997 | Steinlauf | |
| 5,727,271 | A | | 3/1998 | Romanato et al. | |
| 5,729,912 | A | | 3/1998 | Gutkowski et al. | |
| 5,765,296 | A | | 6/1998 | Ludemann et al. | |
| 5,804,011 | A | | 9/1998 | Dutta et al. | |
| 5,813,146 | A | * | 9/1998 | Gutkowski et al. | 36/97 |
| 5,829,171 | A | | 11/1998 | Weber et al. | |
| 5,879,725 | A | | 3/1999 | Potter | |
| 5,893,219 | A | | 4/1999 | Smith et al. | |
| 5,915,820 | A | | 6/1999 | Kraeuter et al. | |
| 5,940,990 | A | | 8/1999 | Barret | |
| 5,946,825 | A | | 9/1999 | Koh et al. | |
| 5,948,707 | A | | 9/1999 | Crawley et al. | |
| 5,974,696 | A | | 11/1999 | Aird et al. | |
| 5,983,524 | A | | 11/1999 | Polegato | |
| 5,996,253 | A | | 12/1999 | Sepector | |
| 6,029,376 | A | | 2/2000 | Cass | |
| 6,050,001 | A | | 4/2000 | Ditrtrich | |
| 6,065,230 | A | | 5/2000 | James | |
| 6,105,279 | A | | 8/2000 | Bouchoms | |
| 6,115,945 | A | | 9/2000 | Ellis, III | |
| 6,119,373 | A | | 9/2000 | Gebhard et al. | |
| 6,122,844 | A | | 9/2000 | Nunez | |
| 6,138,385 | A | | 10/2000 | Jungkind et al. | |
| D433,560 | S | | 11/2000 | Pawlus | |
| 6,205,683 | B1 | | 3/2001 | Clark et al. | |
| 6,519,876 | B1 | | 2/2003 | Geer et al. | |
| 6,920,707 | B1 | * | 7/2005 | Greene et al. | 36/97 |
| 7,155,845 | B2 | | 1/2007 | Durand | |
| 2002/0088145 | A1 | * | 7/2002 | Clark et al. | 36/97 |

FOREIGN PATENT DOCUMENTS

| | | |
|---|---|---|
| FR | 1218101 | 5/1960 |
| FR | 2501480 | 9/1982 |
| WO | WO 92/11776 | 7/1992 |
| WO | WO 96/18317 | 6/1996 |
| WO | WO 01/82733 | 11/2001 |
| WO | WO 02/051273 | 7/2002 |
| WO | WO 02/087375 | 11/2002 |

OTHER PUBLICATIONS

Acor Orthopaedic, Inc., Poron [online], http://www.acor.com/poron.htm, publication date unknown, pp. 1/3-3/3.

Acor Orthopaedic, Inc., SRP [online], http://www.acor.com/srp.htm,[publication date unknown], pp. 1/2-2/2.

Bontex, Our Products [online], http://bontex.com/products.html, [publication date unknown], pp. 1/2-2/2.

* cited by examiner

FOOTWEAR WITH LONGITUDINALLY SPLIT MIDSOLE FOR DYNAMIC FIT ADJUSTMENT

BACKGROUND OF THE INVENTION

1. Field of the Invention

The present invention relates to providing footwear with adjustable width to enable customized width fitting and adjustable width necessitated by changing conditions and activity during wear. The invention concerns, more particularly, articles of footwear having a longitudinal split midsole cooperating with a stretchable upper to enable dynamic fit adjustment.

2. Background of the Invention

Footwear sizing is generally based on the overall length of a wearer's foot with accommodation made for the width or girth of the foot as well. Footwear is generally purchased based on a static measurement of the wearer's foot without much regard to the change in the wearer's foot dimensions that may occur during a reasonable period of wear. Neither short term nor long term changes such as accommodation for the expansion of the foot at the end of a day, or growth of a child's foot within a few months from purchase are factored into the single static measurement at point of purchase.

The shape of the last on which the article of footwear is formed is the primary influence on the fit of an article of footwear. In general a last is made by taking the following foot measurements into account: the overall length of the foot, the width of the foot, the height of the first digit, the contour of the instep, and at least six girth measurements. The general practice is to shape a last for mass production by utilizing foot measurements from a broad spectrum of the population to determine the characteristics of a statistically average foot. This will theoretically achieve a proper fit for a majority of the population. Most footwear manufacturers only provide consumers with footwear in limited length-width combinations.

Prohibitive manufacturing and retail inventory challenges prevent mass manufacturers and marketers from offering footwear sizes in a full spectrum of length-width combinations. Since each length-width combination for an article of footwear generally requires a unique last that is correctly proportioned for that particular length-width combination, economics generally forces manufacturers and retailers to offer a limited spectrum of length-width combinations, based again, on a statistically average foot. The attempt is to cover as large a cross section of the population as possible. Research has demonstrated that this approach, while cost effective, yields little perceivable benefit to the consumer.

Many individuals do not have feet with statistically average proportions so the usual length-width combinations would not provide a proper fit. Some people have feet of left and right feet of different widths, such as the dominant foot being slightly larger. In addition, some individuals have foot proportions that change in a relatively short period of time. Children, for example, often experience rapid growth in the feet that prevent footwear from being worn for a significant portion of the footwear's useful life. Individuals with certain medical conditions, such as pregnancy or edema, may experience day to day changes in foot proportions. Any of these factors necessitate fit adjustment to enable the wearer to receive the full benefit of an athletic shoe in particular.

Due to these limitations, there have been multiple attempts in the prior art to provide for some measure of adjustment. The vast majority of prior art adjustment systems for footwear rely on some sort of mechanism for adjusting fit such as a lacing system, screw adjustments, or ratchet adjustments. The prior art sometimes combines the adjustment mechanisms in the midsole with inserts or other material variances to provide a measure of lateral or width adjustment.

Some prior art attempts to address width adjustment and fit employ articulating midsole and outsole units that are sized with interchangeable plugs. These systems do not allay the inventory problem since often the extra pieces must be inventoried and managed by a retailer.

SUMMARY

The present invention utilizes a longitudinal split midsole with an expansion element integrated with an outsole that allows the midsole to expand from a narrow width to a wider width for a given length. The expansion element shields the interior of the shoe from the elements such as dirt, water, debris. The upper of the shoe has a corresponding section that can expand to a similar degree as the midsole and outsole. This allows the volume of the upper to increase proportionally to the width of the sole.

The footwear of the present invention includes specially designed midsole and outsole cooperating with an upper that is at least partially stretchable to provide customized width fitting and adjustable width necessitated by changing foot size, conditions and activity. The sole is designed with the requisite cushioning properties in a midsole, and at least one longitudinal expansion element integrated with the midsole. The expansion element allows the sole to expand laterally to provide width adjustment. The outsole is designed to accommodate and cooperate with a longitudinal split in the midsole in which the expansion element is disposed.

At least a portion of the upper, foot-covering portion is constructed to stretch for fit adjustment. The bottom insole panel of the upper may be made of a non-stretch material such as a woven fabric, with a longitudinal area of stretch fabric. The longitudinal area of stretch fabric is disposed to cooperate with the expansion element of the sole to enable the entire article of footwear to expand laterally, and for the internal volume to increase as a result.

The insole panel of the upper is comprised of a combination of non-stretch material and a stretch material panel. The non-stretch material includes a number of stays extending laterally across the stretch panel material. The stays retain the shape of the insole panel and prevent it from expanding during lasting. The longitudinal stretch panel of the insole is aligned with the expansion element of the sole, and the upper and sole are attached. After the shoe is lasted and sole laying is completed, the stays of non-stretch material in the insole panel are severed. Severing the stays enables the longitudinal stretch panel to cooperate with the expansion element in the sole to provide width adjustment thus providing a dynamic and interactive fit.

Alternatively, the insole panel may have a simpler construction of a non-material stretch with a cut-out along a longitudinal area to cooperate with the expansion element of the sole. For some sizes of footwear, a cut-out may be a sufficient expansion area for the insole panel. As with the earlier description, the insole panel with a cut-out includes a number of stays that extend laterally across the cut-out to retain the shape and dimensions of the upper prior to and during lasting.

An upper with an integrated insole panel as described above lasted to a sole unit having an expansion element requires no user adjustment, no additional pieces or inserts and no additional molds of tooling. This substantially lowers production costs and allows the retailer to offer width sizing that is more individualized without additional inventory demands.

An individual's foot geometry becomes the controlling element in determining the width of the shoe, as well as where the added width occurs relative to the length of the shoe. That is, whether the width increases near the toe area, the ball of the foot, or the waist of the foot. The stretch panel or cut-out can be tailored to meet the various demands or preferences of consumers. In general, the tighter fit of performance footwear would require more tension in the membrane, whereas a casual shoe may require less tension.

Other configurations, features and advantages of the invention will be, or will became, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
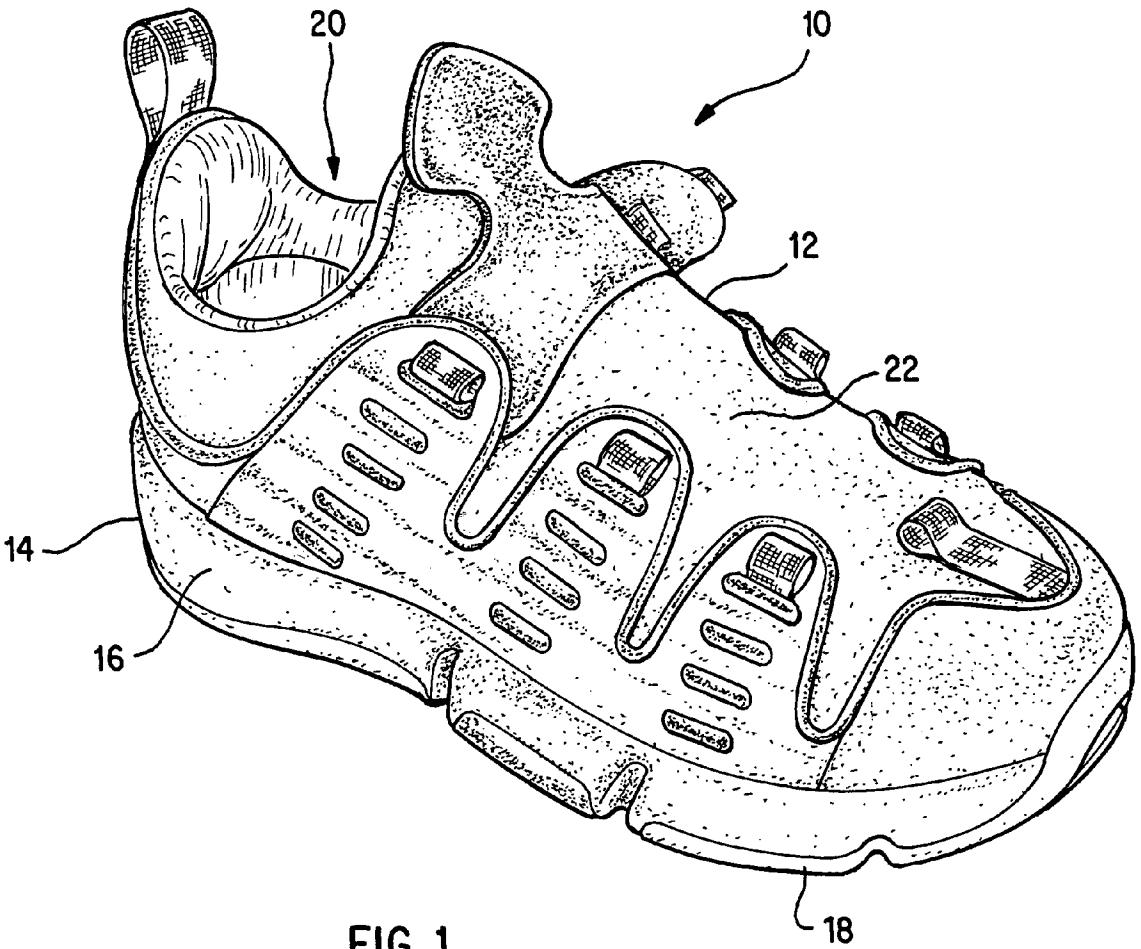
FIG. 1 is a perspective view of an article of footwear in accordance with a preferred embodiment of the invention.

Article of footwear 10 shown in FIG. 1 is formed generally of an upper 12 and a sole unit 14. Sole unit 14 comprises a cushioning midsole 16 and a ground-engaging outsole 18. In this particular shoe, outsole 18 is actually a set of elements on the ground contacting portions of the sole. For simplicity, whether the outsole is unitary or a set of elements, it is referred to as an outsole. Upper 12 has the customary foot opening 20 and a tongue or instep area 22. The particular shoe shown in the figures features an upper made of a stretchable material along with lateral and medial panels extending upward from the sole to include lace loops. The present invention is applicable, however, to many variations on upper construction.

Figure 2:
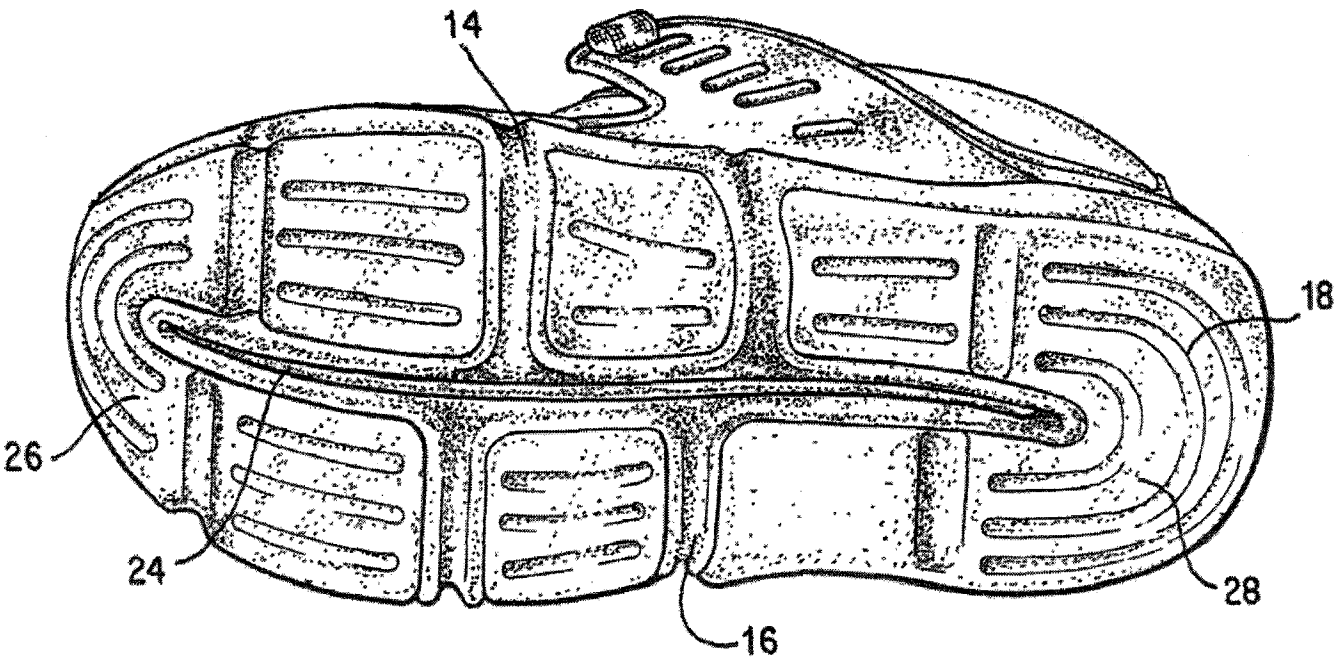
FIG. 2 is a bottom view thereof.
Figure 3:
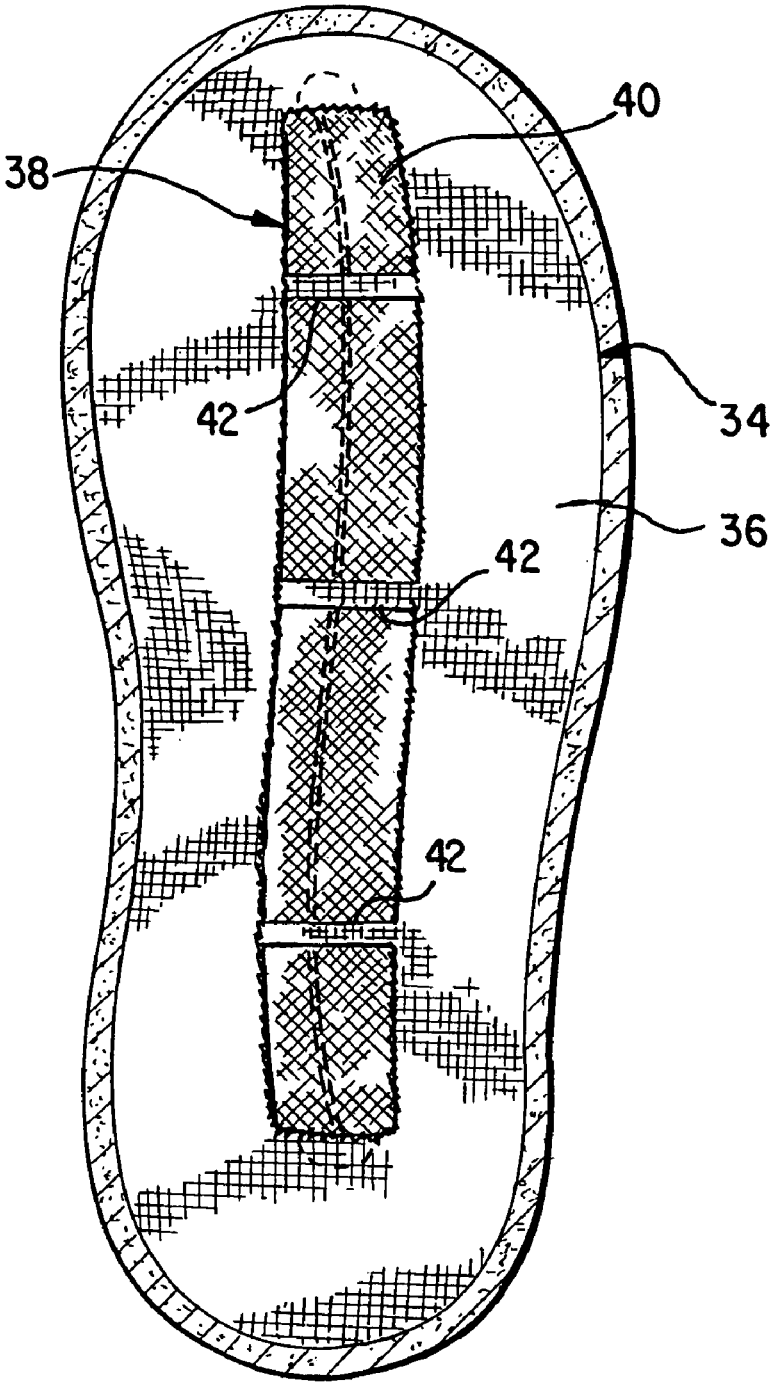
FIG. 3 is a schematic plan view of the insole panel viewed from inside the footwear prior to severing the non-stretchable stays.

As seen in FIG. 2, sole unit 14 of the particular shoe shown in the drawings comprises an outsole 18 which covers a substantial portion of the ground-engaging portion of the sole. Midsole 16 is exposed in a number of interstitial areas between portions of the outsole. Most prominently, along the longitudinal of the shoe bottom, a portion of the midsole is visible as an expansion element 24. Expansion element 24 extends from the toe region 26 to the heel region 28, and is shown in the figures to be a pleat in the midsole. In other words, the expansion element is a longitudinal expansion joint in the midsole which physically splits the midsole between a lateral side and a medial side.

Figure 4:
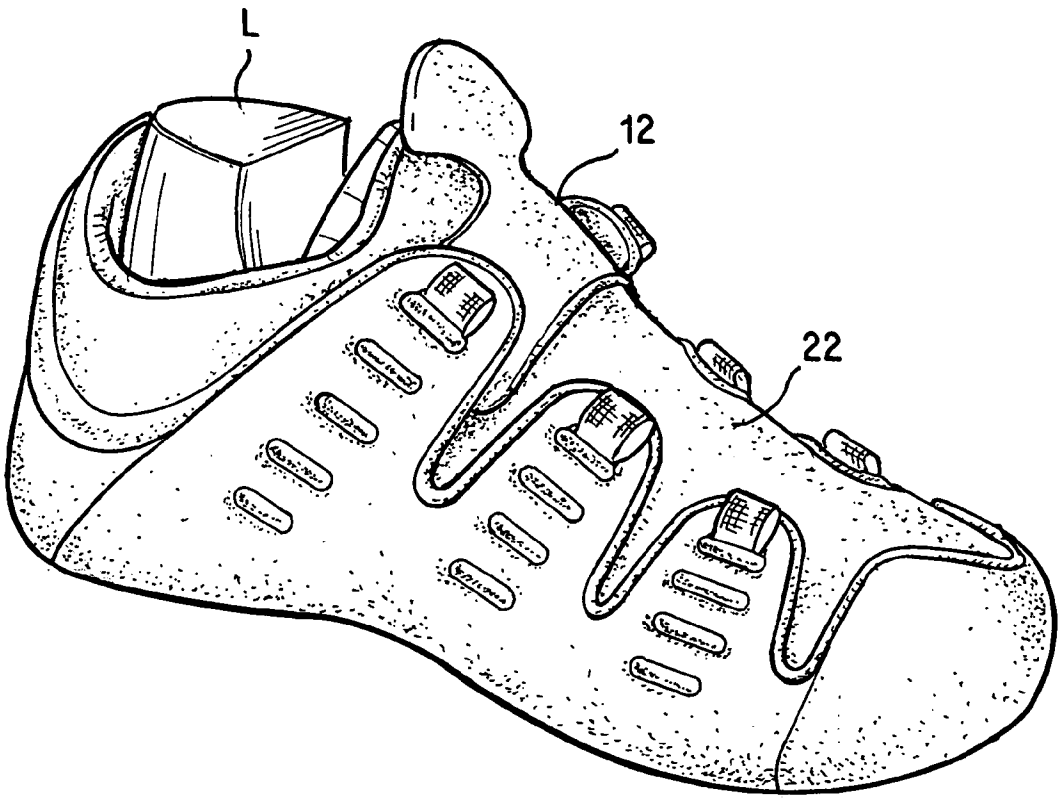
FIG. 4 is a perspective view of a footwear upper on a last, prior to lasting.
Figure 5:
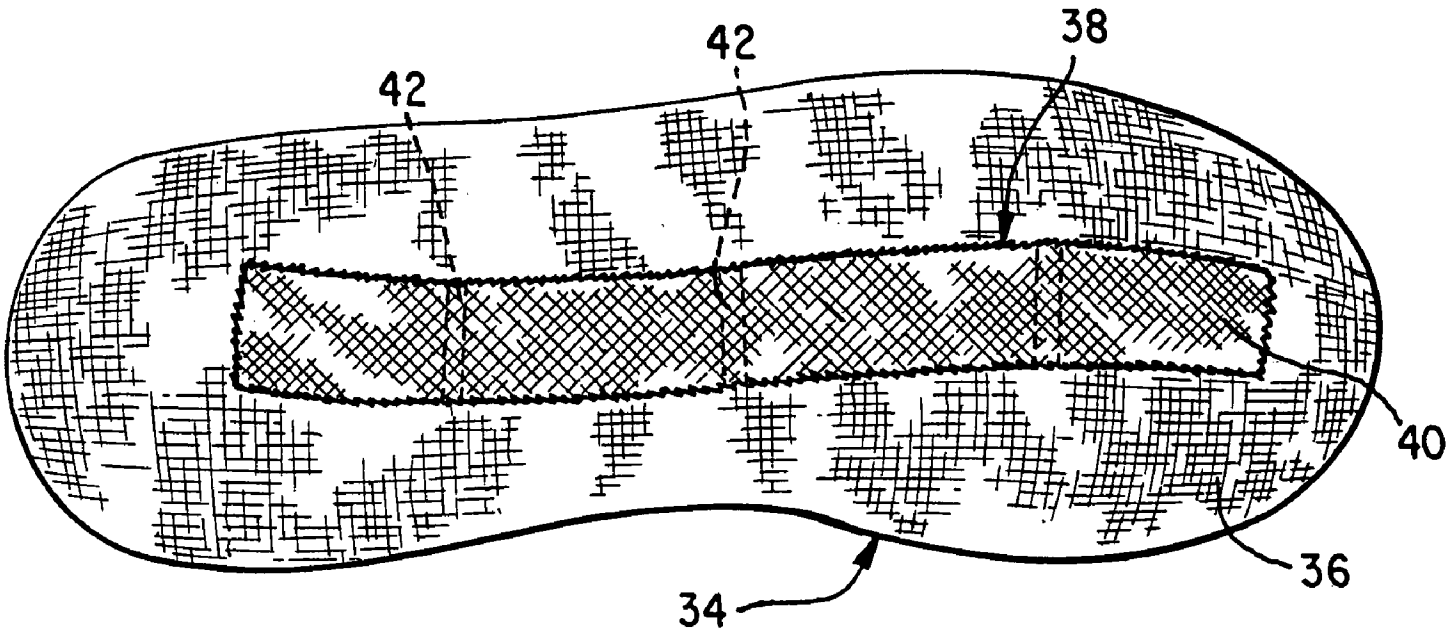
FIG. 5 is a bottom plan view of the footwear upper of FIG. 4.
Figure 6:
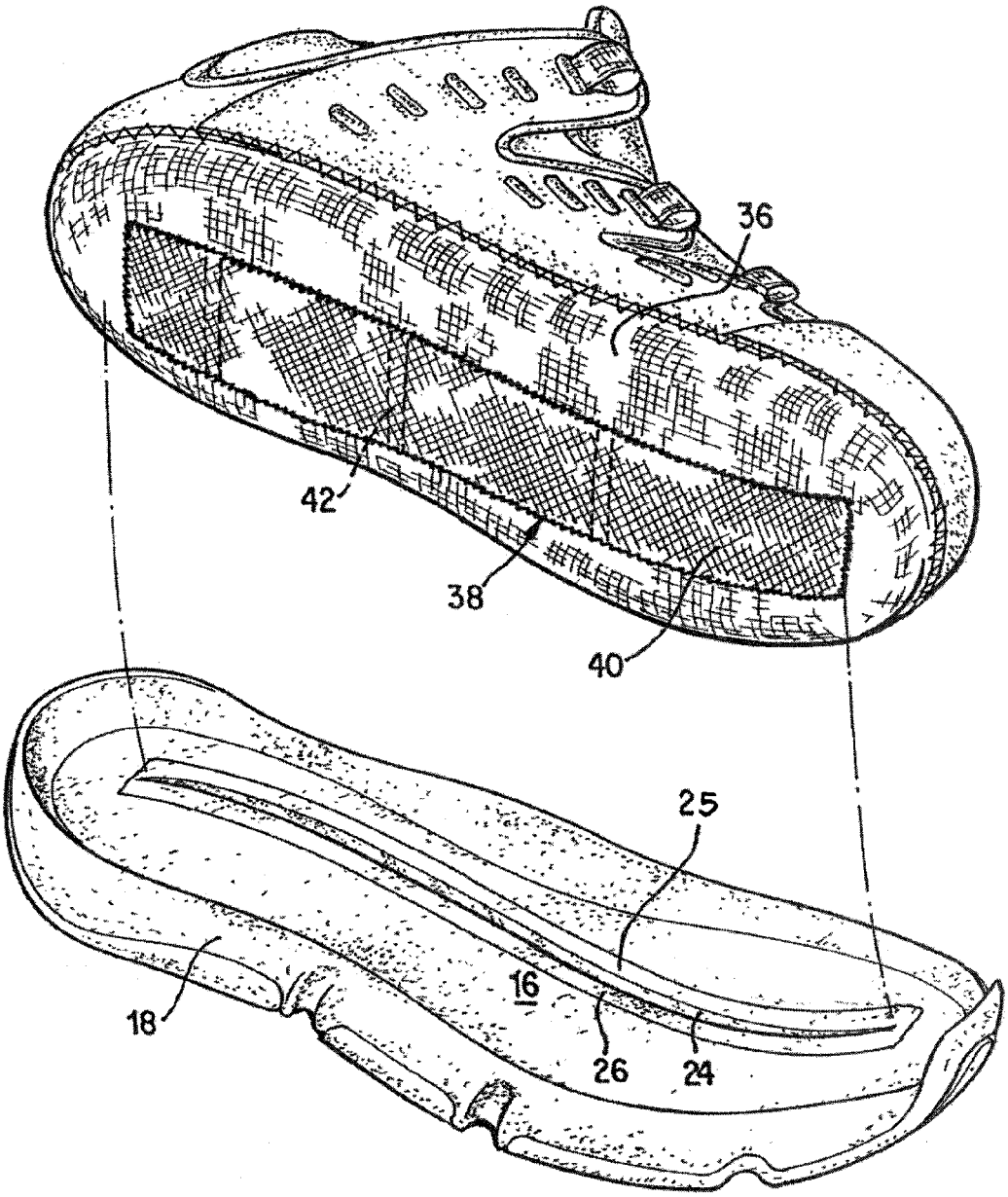
FIG. 6 is an exploded assembly view of the footwear upper of FIG. 4 shown with a sole unit as the pieces would be lasted together.
Figure 7:
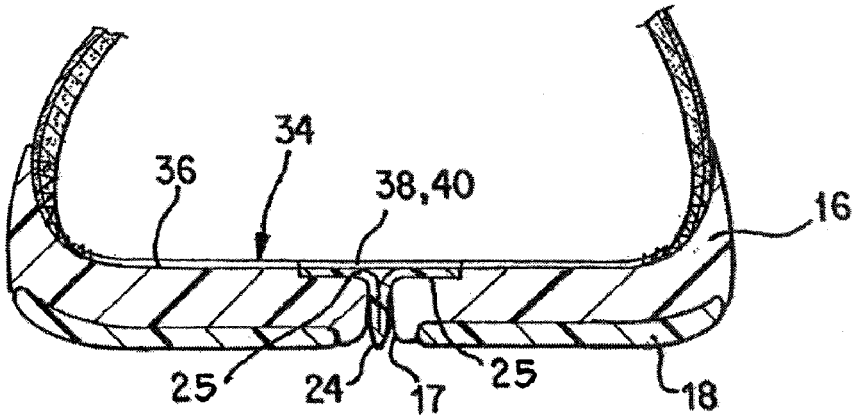
FIG. 7 is a schematic cross-section of the sole unit of the article of footwear shown in the non-expanded condition.
Figure 8:
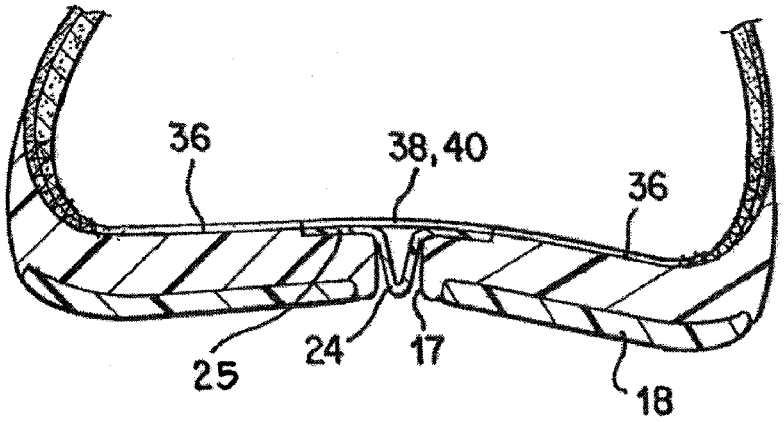
FIG. 8 is a schematic cross-section of the sole area similar to FIG. 7 but shown in an expanded and flexed condition.

In the embodiment shown in FIGS. 1-8, expansion element 24 is actually made of a separate piece of material from midsole 16. As best seen in FIGS. 6-8, expansion element 24 has laterally extending flange areas 25 which are attached to a recessed area in midsole 16. The recessed area is of the same thickness as flanges 25, so that the top surface of midsole 16 is flush. Midsole 16 actually has a split 17 to accommodate the insertion of expansion element 24. The pleated portion of expansion element 24 is visible from the bottom of the shoe, FIG. 2.

A dynamic, interactive adjustable width fit is accomplished by cooperation of the longitudinal expansion joint in the midsole with a particular construction of the upper. The bottom panel of the upper is referred to herein as the "insole panel." The insole panel 34 is attached to the sides of the upper and forms the bottom fabric panel. Viewed from inside the upper, insole panel 34 is shown schematically in FIG. 3. It should be noted that when the shoe is finally assembled for sale, an additional cushioned insole or insole layer will be positioned above the insole panel so that this bottom panel is not visible to the wearer without removal of the insole.

In this embodiment, insole panel 34 is comprised of a non-stretchable portion 36 surrounding a longitudinally oriented expansion portion 38. The non-stretchable portion is preferably made of a woven fabric or the like. Expansion portion 38 is preferably made of a stretch fabric panel 40 that is stitched to non-stretch portion 36 along its periphery. Stretch panel 40 has a generally longitudinal shape which coincides with the location of the expansion element in the sole when the upper and sole unit are attached together. In the embodiment shown in the drawings, non-stretch portion 36 also includes a number of stays 42 integrally formed of the same fabric or material which extend across expansion portion 38. Stays 42 help maintain the shape and dimensions of the upper and prevent insole panel 34 from expanding prior to assembly. Although stays 42 are shown to be integrally formed with the insole panel, they could also be made of a different non-stretch material and attached to insole panel 34 by other means. As long as they fulfill their purpose of maintaining the shape and dimensions of the upper during lasting, both integrally formed stays or stays made of a different material and attached to the insole panel are contemplated to be within the scope of the invention.

In the assembly of the shoe components, upper 12 is fully stitched together and then fitted around a last L, FIG. 4. The bottom of the upper is shown in FIG. 5. Insole panel 34 includes non-stretch portion 36 surrounding the longitudinal stretch panel 40. Stays 42 are shown in broken line since they are on the interior of the shoe. Stays 42 maintain the shape and dimensions of the upper and insole panel during lasting so that the upper has the desired shape and configuration. After lasting, the shoe undergoes a sole laying operation in which the sole unit is attached the lasted upper. The stays also maintain the shape and dimensions of the shoe during sole laying.

It should be noted that the particular shape of stretch panel 40 shown in the drawings is generally for illustration purposes. In practice, stretch panel 40 may be narrower, have pointed ends or curve differently. The overriding factor in the shape of the stretch panel is that it should extend generally in a longitudinal direction with respect to the bottom of the shoe to accommodate lateral expansion.

As best seen in FIG. 6, upper 12 is attached to sole unit 14 such that stretch panel 40 of the upper is vertically aligned to some degree with expansion element 24 in sole unit 14. Both stretch panel 40 and expansion element 24 extend in a longitudinal direction with respect to the shoe. The upper and the sole unit are lasted together in a conventional manner. If any adhesive is used, care must be taken to ensure that the adhesive is not applied to the stretch panel so as not to inhibit any stretching expansion. Once the upper and sole unit are attached, stays 42 are severed from the inside of the shoe. Severing stays 42 enables expansion of stretch panel 40 as necessary to accommodate different widths of feet with respect to the length of the shoe. As can be seen, stretch panel 40 cooperates with expansion element 24 in the sole unit to enable the shoe to expand laterally to achieve a good fit.

Since lateral expansion is function of the stretch panel and the expansion element, there is no reason to supply any additional mechanism or inserts. The fit of the shoe made in this manner is adjustable not just among wearers of different widths, but also to a single wearer whose foot expands during use. As discussed above, providing customized width adjustment reduces the inventory demands on retailers as separate width sizing need not be inventoried for a given length. Also, for some users, it is useful to provide a measure of lateral adjustability as the shape of their feet may change during wear. One example is for people with edema or pregnancy conditions whose feet may grow wider over a short period of time. Width adjustment by the cooperation of the stretch panel and the expansion element provides sufficient lateral range to accommodate such changes. Also for children whose feet are still growing, a shoe with the lateral adjustment of the present invention would accommodate some measure of growth before it must be replaced for a larger size.

This embodiment of the invention encompasses ensuring that at least a portion of the shoe upper which covers the instep of the wearer's foot has elasticity to some degree. For most categories of wearers it may be most comfortable if the shoe not only expands laterally at the sole, but can also expand around the instep to take into account any swelling or growth of the girth of the foot. This will provide the snug fit that is needed for most athletic activities.

The expansion of the longitudinal split midsole in a completed shoe is illustrated schematically in FIGS. 7-8. In these cross-sections, midsole 16 has a longitudinal split 17, and expansion element 24 is seen as a separate T-shaped element with flanges 25 that reside in a recess of corresponding thickness in midsole 16. Insole panel 34 overlays the midsole with stretch panel 40 positioned generally over expansion element 24. In the static condition, i.e. the unexpanded condition, expansion element 24 is retracted, FIG. 7, and the shoe is at its narrowest width. Stretch panel 40 and expansion element 24 are both biased to this retracted, static condition to provide a tight fit.

When the width of the shoe is expanded, either by a wider foot or because of a flexure required by the wearer's activity, stretch panel 40 and expansion element 24 expand laterally to accommodate the width adjustment. The shoe therefore provides dynamic width adjustment by cooperative expansion of the stretch panel and expansion element. Flexure out of the horizontal plane is not necessarily contemplated to be required all of the time, but is illustrated in FIG. 8. Since the stretch panel and expansion element are biased to be retracted, even in their expanded state, they will provide a snug, secure fit to the wearer.

The use of the insole stretch panel in cooperation with a longitudinal split midsole with expansion element enable a single length of shoe to accommodate a variety of widths. Moreover, even for a single wearer whose foot dimensions may change over a short period of time, a single sized shoe will be able to accommodate the changes. In this way, a single last can be used to manufacture a shoe that has a width sizing range from very narrow to extra wide. Of course the size and degree of elasticity of the stretch panel and the expansion element can be adjusted as necessary to provide a smaller or larger range of width sizes per each length size. In addition, these parameters may be customized for a particular shoe depending on the type of activity for which it is designed.

Figure 9:
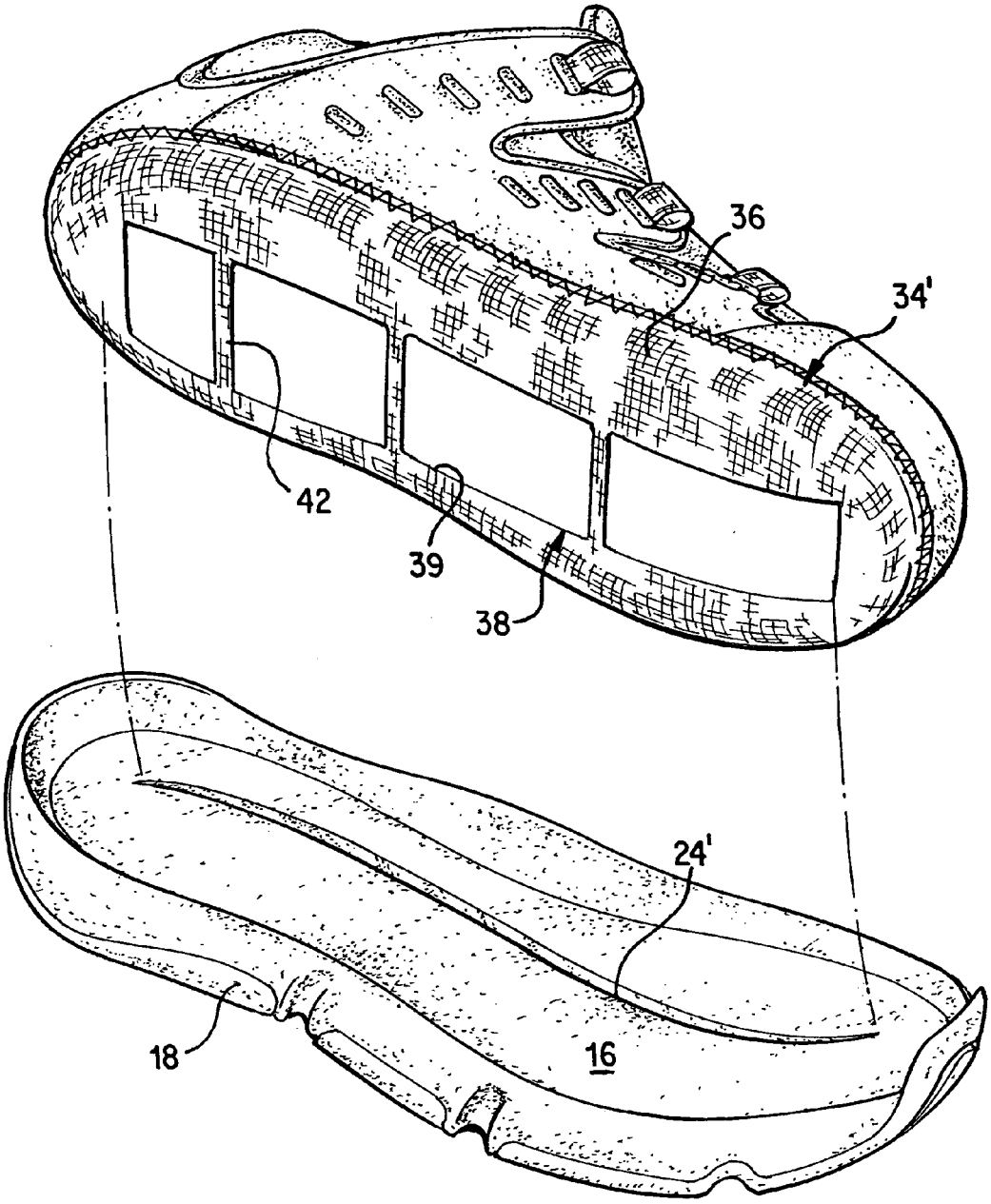
FIG. 9 is an exploded assembly view of an alternative embodiment of the article of footwear, shown as the upper and sole unit would be lasted together.

Among the elements of the shoe that can be varied without changing the fit, function and advantages, are the construction of the insole panel, and the construction of the expansion element. FIG. 9 illustrates variations on both of these elements. First, an alternative insole panel 34' is shown in which a non-stretch portion 36 surrounds an expansion portion 38. But instead of a stretch panel making up the expansion portion, expansion portion 38 is simply a cut-out 39 in the non-stretch portion 36. Otherwise the insole panel 34' is similar to that of the earlier described embodiment, stays 42 extend across the expansion portion 38 to maintain the shape and dimension of the upper prior to and during lasting and sole laying. In some applications, such as smaller sized shoes, the substitution of a cut-out for a stretch panel serves a corresponding expansion function.

Secondly FIG. 9 illustrates an alternative midsole expansion element 24' which is integrally formed with the rest of the midsole material 16. The pleated expansion element 24' is molded together with the midsole and no separate attachment is needed. The integral pleated expansion element longitudinally splits the midsole between the lateral and medial sides to enable expansion therebetween.

Either or both of these modifications are contemplated to be used with the earlier described constructions. That is, the insole panel with a cut-out expansion portion could be paired with a sole unit that has the separately formed pleated midsole element attached within the split midsole. Conversely, the insole panel with a stretch panel expansion portion could be paired with the sole unit with the integrally formed pleated midsole element.

Although not a requirement, at least a portion of the upper should have some elasticity to hold the wearer's foot snugly for optimal fit. This is especially true for shoes using an insole panel with a cut-out expansion portion. Ideally any adjustment in width or internal shoe volume should occur at multiple areas around the wearer's foot, and not just at the bottom.

While various embodiments of the invention have been described, it will be apparent to those of ordinary skill in the art that may more embodiments and implementations are possible that are within the scope of the invention.

What is claimed is:

1. An article of footwear having lateral and medial sides, said article comprising:

an upper including an instep portion for covering at least a portion of a wearer's foot and an insole portion adapted to underlay a wearer's foot, said insole portion comprising a non-stretch portion surrounding an expansion portion disposed longitudinally along said insole portion;

a sole unit attached to said upper underneath said insole, said sole unit comprising a cushioning midsole and a ground engaging outsole, said midsole including a longitudinal split extending from a toe region to a heel region to accommodate an expansion element disposed longitudinally along said sole unit so as to align with said expansion portion of said insole portion, and wherein said midsole is layered between said ground engaging outsole and said insole;

wherein said expansion portion and said expansion element have a retracted static condition to provide a narrower width to said article of footwear, and have an expanded, adjustment condition to provide a wider width and an increased internal volume to said article of footwear to cooperatively provide dynamic width adjustment.

2. The article of footwear of claim 1, wherein said expansion element is a separately formed pleated element attached to said midsole such that said pleated element extends outward and downward through said longitudinal split.

3. The article of footwear of claim 2, wherein said expansion portion comprises a stretch panel of material attached to said non-stretch portion.

4. The article of footwear of claim 3, wherein said insole portion comprises at least one non-stretch stay extending across said expansion portion to prevent said upper from expanding or otherwise losing its shape prior to or during lasting and sole laying.

5. The article of footwear of claim 1, wherein said expansion portion comprises a stretch panel of material attached to said non-stretch portion.

6. The article of footwear of claim 5, wherein said insole portion comprises at least one non-stretch stay extending across said expansion portion to prevent said upper from expanding or otherwise losing its shape prior to lasting and sole laying.

7. The article of footwear of claim 5, wherein said sole unit comprises a cushioning midsole and a ground engaging outsole, and said midsole includes an integrally formed longitudinal expansion element splitting said sole unit between lateral and medial sides.

8. An article of footwear having lateral and medial sides and providing dynamic width adjustment, said article comprising:

an upper including an elastic instep portion for covering at least a portion of a wearer's foot, and an insole portion adapted to underlay a wearer's foot, said insole portion comprising a non-stretch portion surrounding an expansion portion disposed longitudinally along said insole portion;

a sole unit attached to said upper underneath said insole, said sole unit comprising a cushioning midsole and a ground engaging outsole, said midsole being layered between said ground engaging outsole and said insole, said midsole including a longitudinal split extending from a toe region to a heel region and a separately formed expansion element disposed in said split and aligned with said expansion portion of said insole portion and enabling lateral expansion of said sole unit;

wherein said expansion portion and said expansion element have a retracted static condition to provide a narrower width to said article of footwear, and have an expanded, adjustment condition to provide a wider width and an increased internal volume to said article of footwear to cooperatively provide dynamic width adjustment.

9. The article of footwear of claim 8, wherein said expansion element is a separately formed pleated element attached to said midsole such that said pleated element extends outward and downward through said longitudinal split.

10. The article of footwear of claim 9, wherein said expansion portion comprises a stretch panel of material attached to said non-stretch portion.

11. The article of footwear of claim 10, wherein said insole portion comprises at least one non-stretch stay extending across said expansion portion to prevent said upper from expanding or otherwise losing its shape prior to or during lasting and sole laying.

12. The article of footwear of claim 10, wherein said expansion portion comprises a cut-out in said non-stretch portion and said insole portion comprises at least one non-stretch stay extending across said expansion portion to prevent said upper from expanding or otherwise losing its shape prior to or during lasting and sole laying.

13. An article of footwear having lateral and medial sides and providing dynamic width adjustment, said article comprising:

an upper including an elastic instep portion for covering at least a portion of a wearer's foot, and an insole portion adapted to underlay a wearer's foot, said insole portion comprising a non-stretch portion surrounding an expansion portion disposed longitudinally along said insole portion;

a sole unit attached to said upper underneath said insole, said sole unit comprising a cushioning midsole and a ground engaging outsole, wherein said midsole:

is layered between said ground engaging outsole and said insole, and includes a longitudinal split and and an integrally formed longitudinal expansion element, said integrally formed longitudinal expansion element being accommodated in said split, extending from a toe region to a heel region and splitting said sole unit between lateral and medial sides;

wherein said expansion portion and said expansion element have a retracted static condition to provide a narrower width to said article of footwear, and have an expanded, adjustment condition to provide a wider width and an increased internal volume to said article of footwear to cooperatively provide dynamic width adjustment.

14. The article of footwear of claim 13, wherein said expansion portion comprises a stretch panel of material attached to said non-stretch portion.

15. The article of footwear of claim 14, wherein said insole portion comprises at least one non-stretch stay extending across said expansion portion to prevent said upper from expanding or otherwise losing its shape prior to or during lasting and sole laying.

16. The article of footwear of claim 14, wherein said expansion portion comprises a cut-out in said non-stretch portion and said insole portion comprises at least one non-stretch stay extending across said expansion portion to prevent said upper from expanding or otherwise losing its shape prior to or during lasting and sole laying.

17. An article of footwear having lateral and medial sides and providing dynamic width adjustment, said article comprising:

an upper including an elastic instep portion for covering at least a portion of a wearer's foot, and an insole portion adapted to underlay a wearer's foot, said insole portion comprising a non-stretch portion surrounding an expansion portion disposed longitudinally along said insole portion;

a sole unit attached to said upper underneath said insole, said sole unit comprising a cushioning midsole and a ground engaging outsole, said midsole being layered between said ground engaging outsole and said insole, and said midsole including a longitudinal split and a separately formed expansion element disposed in said split and aligned with said expansion portion of said insole portion and enable lateral expansion of said sole unit;

wherein said expansion portion and said expansion element have a retracted static condition to provide a narrower width to said article of footwear, and have an expanded, adjustment condition to provide a wider width and an increased internal volume to said article of footwear to cooperatively provide dynamic width adjustment;

wherein said expansion element is a separately formed pleated element integrally attached to said midsole such that said pleated element extends outward and downward through said longitudinal split; and wherein said expansion portion comprises a stretch panel of material in a cut-out in said non-stretch portion and said insole portion comprises at least one non-stretch stay extending across said expansion portion to prevent said upper from expanding or otherwise losing its shape prior to or during lasting and sole laying.

18. An article of footwear having lateral and medial sides and providing dynamic width adjustment, said article comprising:

an upper including an elastic instep portion for covering at least a portion of a wearer's foot, and an insole portion adapted to underlay a wearer's foot, said insole portion comprising a non-stretch portion surrounding an expansion portion disposed longitudinally along said insole portion;

a sole unit attached to said upper underneath said insole, said sole unit comprising a cushioning midsole and a ground engaging outsole, wherein said midsole:

is layered between said ground engaging outsole and said insole, and includes a longitudinal split and an integrally formed longitudinal expansion element, said integrally formed longitudinal expansion element being accommodated in said split and splitting said sole unit between lateral and medial sides;

wherein said expansion portion and said expansion element have a retracted static condition to provide a narrower width to said article of footwear, and have an expanded, adjustment condition to provide a wider width and an increased internal volume to said article of footwear to cooperatively provide dynamic width adjustment; and wherein said expansion portion comprises a stretch panel of material in a cut-out in said non-stretch portion and said insole portion comprises at least one non-stretch stay extending across said expansion portion to prevent said upper from expanding or otherwise losing its shape prior to or during lasting and sole laying.

* * * * *